United States Patent [19]

Komeda

[11] Patent Number: 5,066,933

[45] Date of Patent: Nov. 19, 1991

[54] BAND-PASS FILTER

[75] Inventor: Yasuhiko Komeda, Tokyo, Japan

[73] Assignee: Kyocera Corporation, Kyoto, Japan

[21] Appl. No.: 564,373

[22] Filed: Aug. 7, 1990

[30] Foreign Application Priority Data

Aug. 30, 1989 [JP] Japan ..... 1-223759

[51] Int. Cl.[5] ..... H01P 1/203

[52] U.S. Cl. ..... 333/204; 333/219

[58] Field of Search ..... 333/202, 1, 205, 219, 333/219.1, 246

[56] References Cited

U.S. PATENT DOCUMENTS

| | | | |
|---|---|---|---|
| 4,264,881 | 4/1981 | De Ronde | 333/204 X |
| 4,313,097 | 1/1982 | de Ronde | 333/204 |
| 4,352,076 | 9/1982 | Saitoh et al. | 333/204 |
| 4,578,656 | 3/1986 | Lacour et al. | 333/204 |
| 4,641,116 | 2/1987 | Shibata et al. | 333/204 |

FOREIGN PATENT DOCUMENTS

| | | | |
|---|---|---|---|
| 0126301 | 7/1984 | Japan | 333/204 |

*Primary Examiner*—Eugene R. LaRoche
*Assistant Examiner*—Seung Ham
*Attorney, Agent, or Firm*—Spensley Horn Jubas & Lubitz

[57] ABSTRACT

A band-pass filter for the microwave band consists of a dielectric substrate, a grounded conductor layer formed on the back surface of the substrate, input and output transmission line conductors formed on the front surface of the substrate, and a plurality of λ/2-length microstrip conductors formed between the input and output transmission line conductors such that they align in parallel over about λ/4 length. A through hole is formed through each λ/2-length microstrip conductor, the substrate and the grounded conductor layer at the center of the microstrip conductor. The λ/2-length microstrip conductor and the grounded conductor layer are electrically connected to each other through a conductive layer formed on the substrate wall of the through hole.

5 Claims, 1 Drawing Sheet

BAND-PASS FILTER

BACKGROUND OF THE INVENTION

This invention relates to a band-pass filter for the microwave or SHF band using resonators each composed of a microstrip line, and is particularly effective when applied to microwave radio equipment.

There is known a band-pass filter for, e.g., the SHF band, in which λ/2-length resonators (λ is the line wavelength corresponding to the central frequency $f_0$ of their passband) each composed of a microstrip line formed on the front surface of a dielectric substrate between an input and an output transmission line which are connected to an external circuit. A grounded conductor layer is formed on the back surface of the dielectric substrate. In such a conventional filter, the adjacent resonators are coupled such that they align in parallel over the length of λ/4 of each resonator. However, due to a spurious resonance mode this arrangement may suffer degradation of its inhibiting characteristics in the vicinity of the integral multiple frequencies of the central frequency, for example, the double frequency of the central frequency.

If such a band-pass filter as cannot effectively attenuate signals outside the required band is applied to a radio transceiver of the SHF band, a receiving sensitivity may be lowered and extraneous waves may be emitted. To avoid these problems, it has been necessary to use additional circuits, making the equipment large and costly.

SUMMARY OF THE INVENTION

It is therefore an object of this invention to provide a band-pass filter which has effective inhibiting characteristics by suppressing a spurious resonance mode in λ/2-length resonators.

Another object is to provide a band-pass filter which can be constructed at low costs without the need for additional circuits to improve the inhibiting characteristics.

According to the present invention, a microstrip line need not be processed into a tapered shape, a projecting-piece shape, etc. In the invention, a through hole is formed through a microstrip conductor, a dielectric substrate and a grounded back conductor layer at the central point (equivalent short-circuit point) of each λ/2-wavelength resonator where a current distribution takes the maximum. Furthermore, the microstrip conductor and the grounded back conductor layer are electrically connected to each other through a conductive layer formed on the substrate wall of the through hole. With this arrangement, the band-pass filter is rendered in a resonance condition only at the central frequency of the passband and is not rendered in a resonance condition at the integral multiple frequencies of the central frequency.

BRIEF DESCRIPTION OF THE DRAWINGS

FIGS. 1A through 1C show embodiments of band-pass filters of the present invention, using resonators composed of microstrip conductors formed on the front surface of a dielectric substrate; wherein FIG. 1A shows a linear transmission line-type;

FIG. 1B shows a hairpin-type; and

FIG. 1C shows an open ring-type.

DETAILED DESCRIPTION OF THE PREFERRED EMBODIMENTS

Embodiments of the invention will now be described with reference to the drawings.

Figure 1A:
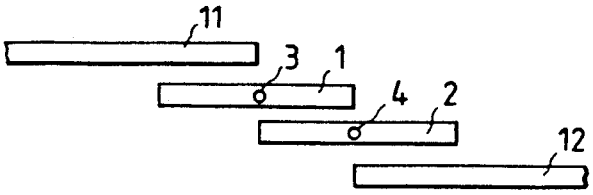
Figure 1B:
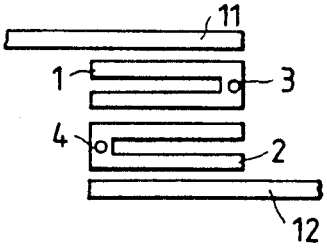
Figure 1C:
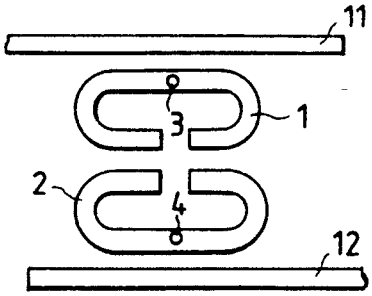

FIGS. 1A through 1C show embodiments of band-pass filters according to the invention, which use a pair of resonators each composed of a λ/2-length microstrip line. FIG. 1A shows an embodiment employing linear transmission line-type resonators, FIG. 1B shows an embodiment employing hairpin-type resonators, and FIG. 1C shows an embodiment employing open ring-type resonators.

In the embodiments of FIGS. 1A through 1C, the overall length of each resonator along the microstrip conductor is set to λ/2. Transmission line conductors 11 and 12 constitute input and output transmission lines, respectively, and microstrip conductors 1 and 2 constitute λ/2 resonators, respectively, and reference numerals 3 and 4 denote through holes formed respectively through the microstrip conductors 1, 2, a dielectric substrate 5 and a grounded conductor layer 6 at the centers of the resonators (i.e., at the position of the λ/4 length).

Figure 1D:
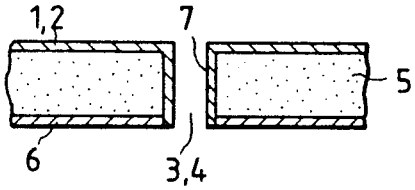
FIG. 1D is a sectional view showing a through hole provided in each resonator.

FIG. 1D is a sectional view showing in detail the through hole 3, 4 provided in the embodiments of FIGS. 1A through 1C. As shown in this figure, the microstrip conductor 1, 2 and the grounded conductor layer 6 are electrically connected to each other through a conductive layer 7 formed on the substrate wall of the through hole 3, 4. The conductive layer 7 may be formed by the vacuum vapor deposition together with the microstrip conductor 1, 2 so as to reach the grounded conductor layer 6, as shown in FIG. 1D.

Characteristics of the resonator consisting of the λ/2-length microstrip conductor, which has the through hole at the central point, will now be described with reference to FIGS. 2 and 3.

Figure 2:
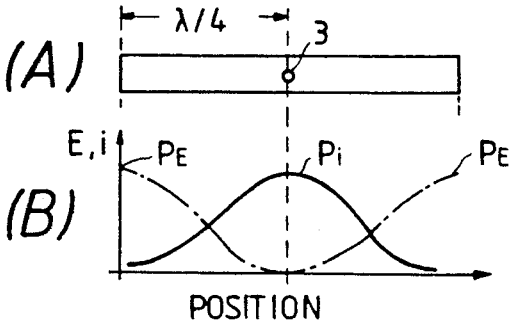
FIG. 2 shows a linear transmission line-type λ/2 resonator having the through hole at the central point, and charge and current distributions thereof.

In part (B) of FIG. 2, a dot-and-dash line represents a charge distribution curve for the microstrip conductor of part (A) of FIG. 2, and a solid line represents a current distribution curve for the same. The maximum points of the charge (E) and current (i) distributions at the fundamental resonance frequency $f_0$ are represented by $P_E$ and $P_i$, respectively, where the peak of the charge distribution appears at the open ends of the microstrip conductor.

Figure 3:
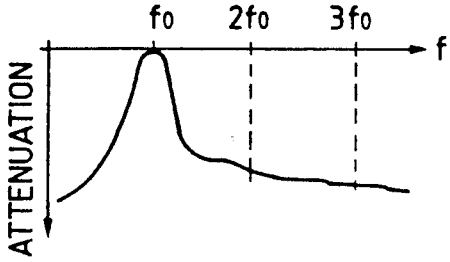
FIG. 3 shows a bandpass characteristic of the band-pass filter of the present invention.

By providing the through hole at the center of the microstrip conductor, where the current distribution takes the maximum, the band-pass filter is rendered in a resonance condition at the frequency $f_0$ but is not rendered in a resonance condition at the integral multiple frequencies thereof $2f_0$, $3f_0$, etc., as shown in FIG. 3.

Although the characteristics have been explained with respect to the microstrip conductor of the linear transmission line-type, it will be appreciated that similar characteristics are obtained with respect to the hairpin-type and the open ring-type shown in FIGS. 1B and 1C.

Although FIGS. 1A through 1C show a pair of λ/2 resonators, the number of the resonators is not limited to two, but may be selected to be more than two so as to realize desired characteristics of the filter. Furthermore, it is noted that the parallel-aligning length (coupling length) of the adjacent λ/2-length microstrip conductor is not limited to the λ/4 length, but may be shorter than the λ/4 length. (The bandpass characteristic and loss of the filter changes depending on the coupling length).

In the band-pass filter according to the present invention, there is no need to process the microstrip line to deform it, and to increase the overall area of the filter, so that costs in manufacture, material and processing can be considerably reduced. Further, the resonance condition is maintained only at the fundamental frequency of the passband, and the higher harmonic components, i.e., integral multiple components can be markedly attenuated, which greatly contributes to improvement in spurious characteristics.

Accordingly, any additional circuit is not needed for preventing degradation of the inhibiting characteristics, and therefore the filter designing can be facilitated.

What is claimed is:

1. A band-pass filter comprising:

a dielectric substrate;

a grounded conductor layer formed on a back surface of the dielectric subsrtrate;

an input transmission line conductor and an output transmission line conductor both formed on a front surface of the dielectric substrate;

a plurality of resonators, each resonator having a fundamental resonance frequency $f_0$, each resonator comprising a λ/2-length microstrip conductor (where λ is the line wavelength correspond to the fundamental resonance frequency, $f_0$) formed on the front surface of the dielectric substrate between the input and output transmission line conductors such that an adjacent pair of the plurality of microstrip conductors align in parallel over a predetermined length which is equal to or less than the λ/4 length; and a through hole formed through each of the plurality of microstrip conductors, the dielectric substrate and the grounded conductor layer at a center of the microstrip conductor, the through hole having a conductive layer formed on a wall of the dielectric substrate and electrically connecting the microstrip conductor and the grounded conductor layer;

wherein the band-pass filter is rendered in a resonance condition only at the fundamental resonance frequency $f_0$.

2. A band-pass filter according to claim 1, wherein the pair of λ/2-length microstrip conductors are of a linear transmission line type.

3. A band-pass filter according to claim 1, wherein the pair of λ/2-length microstrip conductors are of a hairpin type.

4. A band-pass filter according to claim 1, wherein the pair of λ/2-length microstrip conductors are of an open ring type.

5. The band-pass filter of claim 1 wherein the ends of each microstrip conductor are insulated from the grounded conductor layer.

* * * * *